US008549674B2

(12) United States Patent
Kraemer et al.

(10) Patent No.: US 8,549,674 B2
(45) **Date of Patent: *Oct. 8, 2013**

(54) SHOULDER PADS

(75) Inventors: Nelson Kraemer, Mount Prospect, IL (US); Vittorio Bologna, Elk Grove Village, IL (US); Ralph Infusino, Bloomingdale, IA (US); Thad M. Ide, Chicago, IL (US)

(73) Assignee: Riddell, Inc., Rosemont, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/544,784

(22) Filed: Jul. 9, 2012

(65) Prior Publication Data

US 2013/0000023 A1 Jan. 3, 2013

Related U.S. Application Data

(63) Continuation of application No. 12/584,896, filed on Sep. 14, 2009, now Pat. No. 8,214,929, which is a continuation-in-part of application No. 12/381,554, filed on Mar. 13, 2009, now Pat. No. 7,930,773, which is a continuation of application No. 11/224,493, filed on Sep. 12, 2005, now Pat. No. 7,506,384.

(60) Provisional application No. 60/609,489, filed on Sep. 13, 2004.

(51) Int. Cl.
*A41D 13/00* (2006.01)

(52) U.S. Cl.
USPC ..... 2/459

(58) Field of Classification Search
USPC ..... 2/44, 45, 267, 268, 94, 102, 459
See application file for complete search history.

(56) References Cited

U.S. PATENT DOCUMENTS

| | | | | | |
|---|---|---|---|---|---|
| 4,295,227 | A | * | 10/1981 | Mitchell | 2/462 |
| 4,322,859 | A | * | 4/1982 | Mitchell | 2/462 |
| 4,441,211 | A | * | 4/1984 | Donzis | 2/459 |
| 4,467,475 | A | * | 8/1984 | Gregory et al. | 2/462 |
| 4,486,901 | A | * | 12/1984 | Donzis | 2/462 |
| 4,513,449 | A | * | 4/1985 | Donzis | 2/462 |
| 4,872,216 | A | * | 10/1989 | Wingo, Jr. | 2/462 |
| 4,874,640 | A | * | 10/1989 | Donzis | 427/512 |
| 4,926,503 | A | * | 5/1990 | Wingo Jr | 2/461 |
| 4,985,931 | A | * | 1/1991 | Wingo, Jr. | 2/462 |
| 5,029,341 | A | * | 7/1991 | Wingo, Jr. | 2/462 |
| 5,035,009 | A | * | 7/1991 | Wingo et al. | 2/414 |
| D328,159 | S | * | 7/1992 | Donzis | D29/100 |
| 5,159,715 | A | * | 11/1992 | Jurga et al. | 2/462 |
| 5,235,715 | A | * | 8/1993 | Donzis | 12/142 R |

(Continued)

*Primary Examiner* — Tejash Patel
(74) *Attorney, Agent, or Firm* — McDermott Will & Emery LLP

(57) ABSTRACT

The present invention provides a shoulder pad for use in a contact sport, such as football, hockey or lacrosse. The shoulder pad includes a pair of arch members, each having an upper portion, a front portion depending from the upper portion, and a rear portion depending from the upper portion. The shoulder pad further includes at least one side pad assembly having an epaulet and a shoulder cap, wherein the shoulder cap overlies the wearer's shoulder region and the epaulet overlies both the arch member and the shoulder cap. The side pad assembly is operably secured to the body arch member by a fastening assembly that includes a flexible single band. The single band secures both the epaulet and the shoulder cap to the upper portion of the arch member.

20 Claims, 10 Drawing Sheets

(56) References Cited

U.S. PATENT DOCUMENTS

| | | | | | |
|---|---|---|---|---|---|
| 5,404,590 | A * | 4/1995 | Monica, Jr. | ..... | 2/468 |
| 5,794,275 | A * | 8/1998 | Donzis | ..... | 2/455 |
| 5,881,395 | A * | 3/1999 | Donzis | ..... | 2/455 |
| 6,175,967 | B1 * | 1/2001 | Donzis | ..... | 2/413 |
| 6,425,195 | B1 * | 7/2002 | Donzis | ..... | 36/88 |
| 7,506,384 | B2 * | 3/2009 | Ide et al. | ..... | 2/459 |
| 7,930,773 | B2 * | 4/2011 | Ide et al. | ..... | 2/459 |
| 8,214,929 | B2 * | 7/2012 | Kraemer et al. | ..... | 2/459 |

* cited by examiner

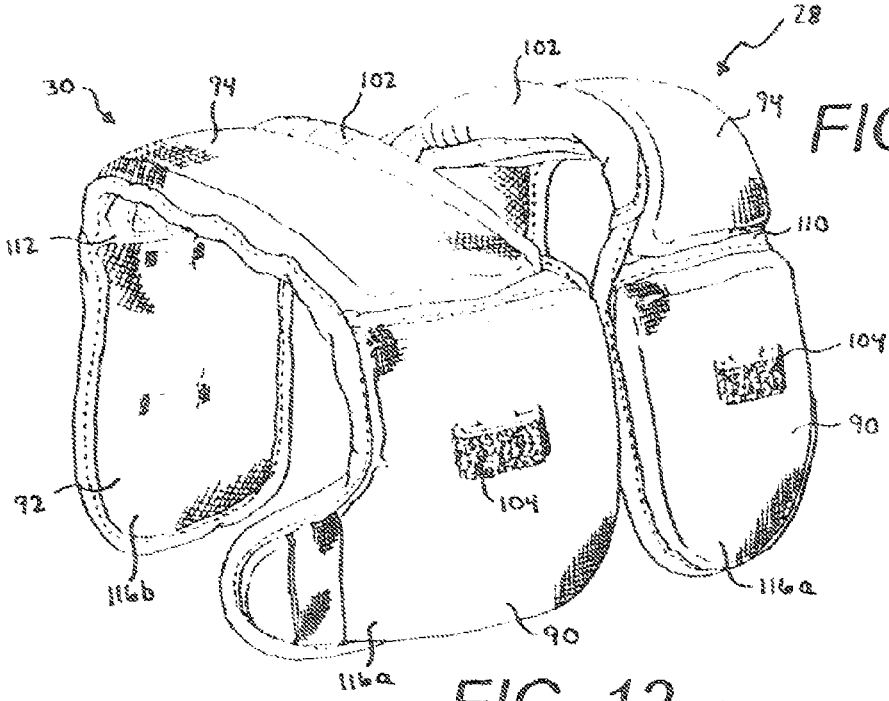
FIG. 11
FIG. 12
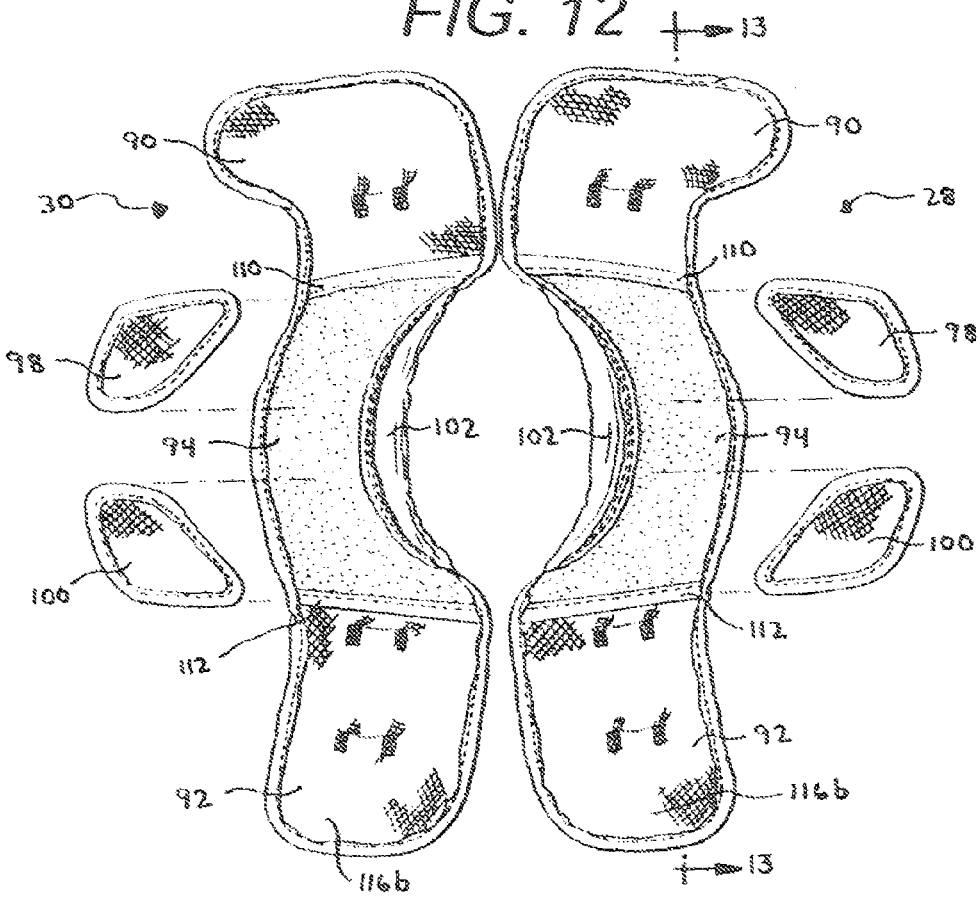

SHOULDER PADS

CROSS-REFERENCE TO RELATED APPLICATIONS

This application is a continuation of U.S. patent application Ser. No. 12/584,896, filed Sep. 14, 2009, which is a continuation-in-part of U.S. application Ser. No. 12/381,554, filed Mar. 13, 2009, now U.S. Pat. No. 7,930,773, which is a continuation of U.S. application Ser. No. 11/224,493, filed Sep. 12, 2005, now U.S. Pat. No. 7,506,384, which claims the benefit of and priority to U.S. Provisional Application No. 60/609,489, filed Sep. 13, 2004. The entire contents of each of the foregoing are hereby incorporated by reference herein.

FEDERALLY SPONSORED RESEARCH OR DEVELOPMENT

Not applicable.

TECHNICAL FIELD

The invention relates to a shoulder pad assembly worn by a player in a contact sport, such as football, lacrosse or hockey. The shoulder pad is formed from a novel, high-strength, low weight material and includes a fastening assembly for connection of a side pad assembly, an energy attenuation system for dissipating an impact force, and an integrated interior pad assembly.

BACKGROUND OF THE INVENTION

In most contact sports, the players are required to wear an assortment of protective gear, including shoulder pads, to reduce the occurrence of injury. For example, conventional football shoulder pads are bilaterally symmetrical and are generally comprised of right and left body arch members which extend over the shoulders and include anterior and posterior portions, or depending chest and back portions, which overlie the chest and back of the athlete. The posterior portions, or depending back portions may be permanently hinged together along a vertical axis over the athlete's back or spine, while the anterior portion, or depending chest portions, are connected together on a vertical line over the athlete's sternum as by means of straps or lacing.

A side pad assembly, comprising an epaulet and a shoulder cap, is rigidly linked by multiple connectors to the body arch member. The side pad assembly protects the player's shoulder wherein a portion of the body arch member overlies the acromioclavicular area (the "A.C." area), which includes the clavicle and the acromion, where the latter is the lateral extension of the spine of the scapula. In general, the A.C. area of the shoulder extends from the base of the neck downwardly towards the tip of the shoulder, or deltoid muscle. With conventional shoulder pad designs, the epaulet is pivotally connected to the arch member by a first strap and the shoulder cap is pivotally connected to the arch member by a second strap, wherein the epaulet overlies the shoulder cap. Due to the rigid connection provided by the straps, the range of motion of the side pad assembly is limited and the overall comfort of the shoulder pad is affected. The structural members, such as the body arch members, the shoulder caps and the epaulets, are manufactured from a material having the requisite strength characteristics to withstand the forces of impact incurred while playing contact sport. Conventional shoulder pads may also include a strap of material which has its ends fixedly secured to the body arch member, as by rivets or other suitable connectors. Typically, these straps are referred to as cantilever straps, and they support the body arch members in a spaced relationship from the pad body, as well as from the shoulder of the player.

Unlike football shoulder pads which include two distinct pads, the epaulet and the cap, which overlie the player's shoulder for protection thereof, conventional hockey and lacrosse pads feature only the shoulder cap. Hockey and lacrosse pads do not include the additional epaulet for a number of reasons, including the oversized configuration of the cap, the lower profile of the shoulder pads, and the reduced level of contact in these sports compared to football.

Existing shoulder pads also utilize a number of distinct interior pads disposed beneath the body arch members, wherein the interior pads are either fixedly secured, or releasably secured, to the body arch members. By using a number of distinct interior pads to form the interior pad elements, the construction of the shoulder pad and the fit of the shoulder pad can be affected.

Therefore, there is a definite need for a shoulder pad with a fastening assembly for the side pad assembly that does not inhibit the range of motion or comfort of the pad assembly. Further, there is a tangible need for an integrated interior pad assembly that can be quickly and easily joined to the arch members during the construction of the shoulder pad. There is also a tangible need for a lighter shoulder pad that maintains the required strength and durability.

The present invention is provided to solve the problems discussed above and other problems, and to provide advantages and aspects not provided by prior shoulder pads.

SUMMARY OF THE INVENTION

The present invention relates to a shoulder pad that is to be worn by a participant of a contact sport, such as football, hockey or lacrosse. The shoulder pad includes a first body arch member, a second body arch member, a left side pad assembly flexibly connected to the left body arch member, and a right side pad assembly flexibly connected to the right body arch member. The shoulder pad further includes a left interior pad assembly removably affixed to the left body arch member and a right interior pad assembly removably affixed to the right body arch member.

According to one aspect of the invention, each side pad assembly includes an epaulet and an attached interior pad, and a shoulder cap and an attached interior pad. The arch members, the epaulets, and the shoulder caps are made of a material having the requisite strength and rigidity requirements to withstand the forces of impact incurred in the contact sport. Each side pad assembly is affixed to the upper portion of the body arch member by a fastening assembly that comprises a single flexible band and at least one rivet. Unlike conventional shoulder pad designs, the single band connects both the epaulet and the shoulder cap to the body arch member. The band has a first end that is affixed to the upper portion of the body arch member by a securing plate and at least one rivet that is driven therethrough. The band has an intermediate portion between the first end and a second end, wherein the intermediate portion is affixed to an inner surface of the epaulet by at least one rivet. The second end of the band is affixed to an inner surface of the shoulder cap by at least one rivet. Thus, a single flexible band is utilized to connect both the epaulet and the shoulder cap to the body arch member while providing a greater range of motion to the side pad assembly.

According to another aspect of the invention, the shoulder pad assembly includes an impact distribution and energy attenuation system that distributes and reduces an impact force throughout the pad assembly. As part of the system, the arch member has a raised segment that is aligned and cooperatively dimensioned with a raised segment of the shoulder cap. Furthermore, the epaulet has a raised segment that is aligned and cooperatively dimensioned with the other raised segments. The raised segments collectively define a channel that distributes and attenuates the force of impact received on the side pad assembly.

According to yet another aspect of the invention, the left and right interior pad assemblies comprise a number of distinct pads joined as an integrated padding unit. The interior pad assembly comprises a number of pads—a front pad, an intermediate pad, and a rear pad—joined to form distinct air management chambers. The pad element is formed from open-cell foam or closed-cell foam, or a combination thereof. The interior pad assembly may include a deltoid pad, wherein the deltoid pad extends from a portion of the front and intermediate pads. A front region of the interior pad assembly includes means for securing the pad assembly to the front portion of the body arch. Similarly, a rear region of the interior pad assembly includes means for securing the pad assembly to the rear portion of the body arch.

According to yet another aspect of the invention, the structural members, such as the body arch members, the shoulder caps and the epaulets, may be manufactured from novel thermoplastic composite material providing increased material strength characteristics while decreasing the weight of the structural members which results in a lighter and stronger pad assembly.

Compared to conventional shoulder pads, the present invention provides a number of advantages. The fastening assembly that secures the side pad assembly to the body arch member provides a greater amount of mobility for the side pad assembly with respect to the arch member. In addition, the fastening assembly comprises few parts, primarily the single band, and is easily installed on the shoulder pad thereby reducing both material and assembly costs. The raised segments of the arch member, the shoulder cap, and the epaulet form the distribution and energy attenuation system that distributes and generally reduces an impact force throughout the pad assembly. Regarding the integrated interior pad assembly, combining multiple pads into a single pad assembly provides for more efficient air management upon an impact to the shoulder pad. The novel thermoplastic composite material provides for a stronger and lighter pad assembly providing additional protection while reducing the strain on the participant. Furthermore, due to the integrated construction of the interior pad assembly, the shoulder pad is more comfortable for the participant to wear while playing the contact sport.

Other features and advantages of the invention will be apparent from the following specification taken in conjunction with the following drawings.

BRIEF DESCRIPTION OF THE DRAWINGS

FIG. 11 is a perspective view of an interior pad assembly of the shoulder pad of FIG. 1;

FIG. 12 is a top plan view of the interior pad assembly of FIG. 11; and, FIG. 13 is a cross section of the interior pad assembly taken along line 13-13 of FIG. 12.

DETAILED DESCRIPTION

Figure 1:
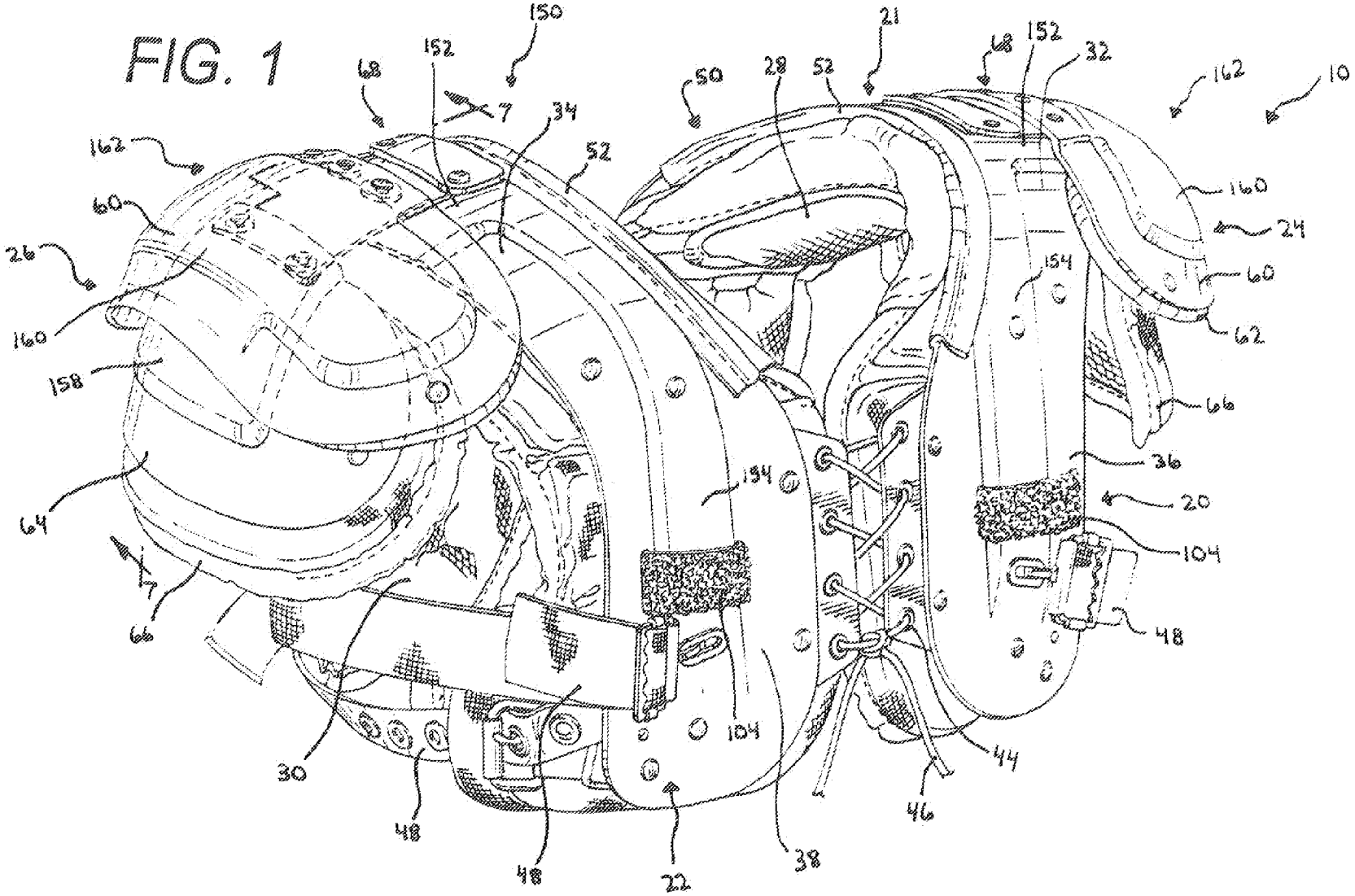
FIG. 1 is a front view of a shoulder pad of the invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A shoulder pad assembly 10 is shown in FIGS. 1 and 4-7. The shoulder pad 10 is configured to be worn by a participant of a contact sport, such as football, hockey or lacrosse. The shoulder pad 10 includes a first or left body arch member 20, a second or right body arch member 22, a left side pad assembly 24 flexibly connected to the left body arch member 20, and a right side pad assembly 26 flexibly connected to the right body arch member 22. A central body 21 is defined by the left and right body arch members 20, 22 which are operably joined to form the central body 21. Each of the side pad assemblies 24, 26 are configured to overlie a shoulder region of the wearer. The shoulder pad assembly 10 further includes a left interior pad assembly 28 removably affixed by fastening means 104 (see FIG. 11) to the left body arch member 20 and a right interior pad assembly 30 removably affixed by fastening means 104 to the right body arch member 22. Alternatively, the interior pad assemblies 28, 30 are permanently affixed to the respective body arch members 20, 22. The shoulder pad 10 may include a cantilever strap (not shown) positioned between each arch member 20, 22 and interior pad assembly 28, 30. In another configuration, the shoulder pad 10 includes a sub-arch padding element 15 (see FIG. 6) positioned between each arch member 20, 22 and interior pad assembly 28, 30. The cantilever strap and/or the sub-arch generally overlie the player's A.C. area and help to protect this area. The terms player, participant and wearer are used herein to denote a person that wears the shoulder pad assembly 10 for use in a contact sport.

Each body arch member 20, 22 includes an upper portion 32, 34, a front or chest portion 36, 38 depending from the upper portion 32, 34, and a rear or back portion 40, 42 depending from the upper portion 32, 34. Thus, the arch member 20, 22 is a single piece that extends between the wearer's lower chest region and lower back region. As shown in FIG. 1, the front portions 36, 38 feature a plurality of eyelets 44 configured to receive a string or lace 46 to adjust and position the body arch members 20, 22 over the wearer's sternum. Each body arch member 20, 22 includes at least one means for adjustably connecting the front portion 36, 38 and the rear portion 40, 42 thereof. The adjustable connection means can include a belt and buckle arrangement 48 or a hook and loop (Velcro.RTM.) strap. The rear portions 40, 42 of the arch members 20, 22 are spaced a distance apart and are connected by at least one strap affixed to the arch members 20, 22. The body arch members 20, 22 define a central opening 50 that permits the shoulder pad 10 to be placed over the participant's head and on the participant's shoulders. Each body arch member 20, 22 has a liner 52 along an extent of the edge proximate the central opening 50.

As shown in FIGS. 1 and 4-7, the side pad assembly 24, 26 includes an epaulet protective element 60 and an attached interior pad 62, and a shoulder cap protective element 64 and an attached interior pad 66. Preferably, the interior pads 62, 66 are attached to the epaulet 60 and the shoulder cap 64, respectively, by at least one rivet 51 (see FIG. 4). Alternatively, one or both of the interior pads 62, 66 are omitted from the side pad assembly 24, 26. The side pad assembly 24, 26 overlies and protects the deltoid muscle of the participant, wherein the epaulet 60 and interior pad 62 overlie the A.C. area and the upper deltoid muscle region, and the cap 64 and interior pad 66 overlie the outer region of the deltoid muscle. Described in a different manner, the shoulder cap 64 also overlies the acromion bone of the wearer, where the acromion is the lateral extension of the spine of the scapula, and the epaulet 60 overlies both the arch member 20, 22 and the cap 64. In one embodiment, the epaulet 60 has a curvilinear periphery with a perimeter that is less than a perimeter defined by the attached interior pad 62. Similarly, the shoulder cap 64 has a curvilinear periphery with a perimeter that is less than a perimeter defined by the attached interior pad 66. In this manner, the periphery of the interior pads 62, 66 extend beyond the periphery of the epaulet 60 and the cap 64, respectively. The arch members 20, 22, the epaulets 60, and the shoulder caps 64 can be made of a material having the requisite strength and rigidity requirements to withstand the forces of impact incurred in the contact sport. As explained below, the arch members 20, 22, the epaulets 60, and the shoulder caps 64 are formed from a polypropylene composite material, namely a coextruded polypropylene tape yarn that reduces the overall weight of the shoulder pad, instead of conventional high molecular weight polyethylene.

Referring to FIGS. 1 and 4-7, each side pad assembly 24, 26 is affixed to the upper portion 32, 34 of the body arch member 20, 22 by a fastening assembly 68 that comprises a single flexible band 70 and a plurality of rivets 72. The band 70 can be operably connected to either an upper surface or a lower surface of the body arch member 20, 22. The band 70 provides a common connection point on the arch member 20, 22 for both the epaulet 60 and the shoulder cap 64. The band 70 has a first end 74 that is affixed to the upper portion 32, 34 by a securing plate 76 and at least one rivet 72 that is driven therethrough. Alternatively, the securing plate 76 is omitted and the rivet 72 extends through the first end 74 of the band 70 and the arch member 20, 22. The rivet 72 can include a protective sheath 73 (see FIGS. 6 and 7). In yet another alternative, the first end 74 of the band 70 is secured under the liner 52 about the central opening 50 and both the plate 76 and the rivet 72 are omitted. Although the plate 76 is shown to have a generally rectangular configuration in FIG. 1, the precise configuration of the plate 76 can vary. For example, the plate 76 can have a square, elliptical, or circular configuration provided there is a sufficient surface area to interface with the first end 74 of the band 70, the upper portion 32, 34 and the rivet 72. The band 70 has a first or inner surface 78 that is in contact with an outer surface of the upper portion 32, 34, and a second or outer surface 80 (see FIG. 5) with portions that are in contact with the plate 76 and exposed (see FIG. 4).

Figure 4:
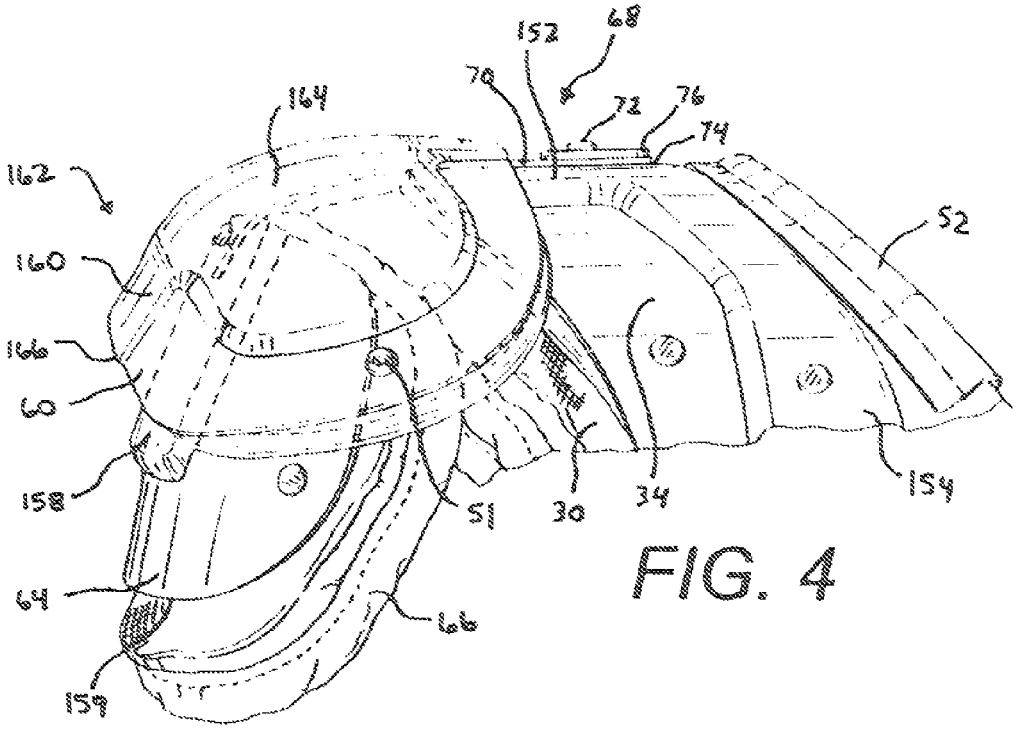
FIG. 4 is a perspective view of a side pad assembly of the shoulder pad assembly of FIG. 1.
Figure 5:
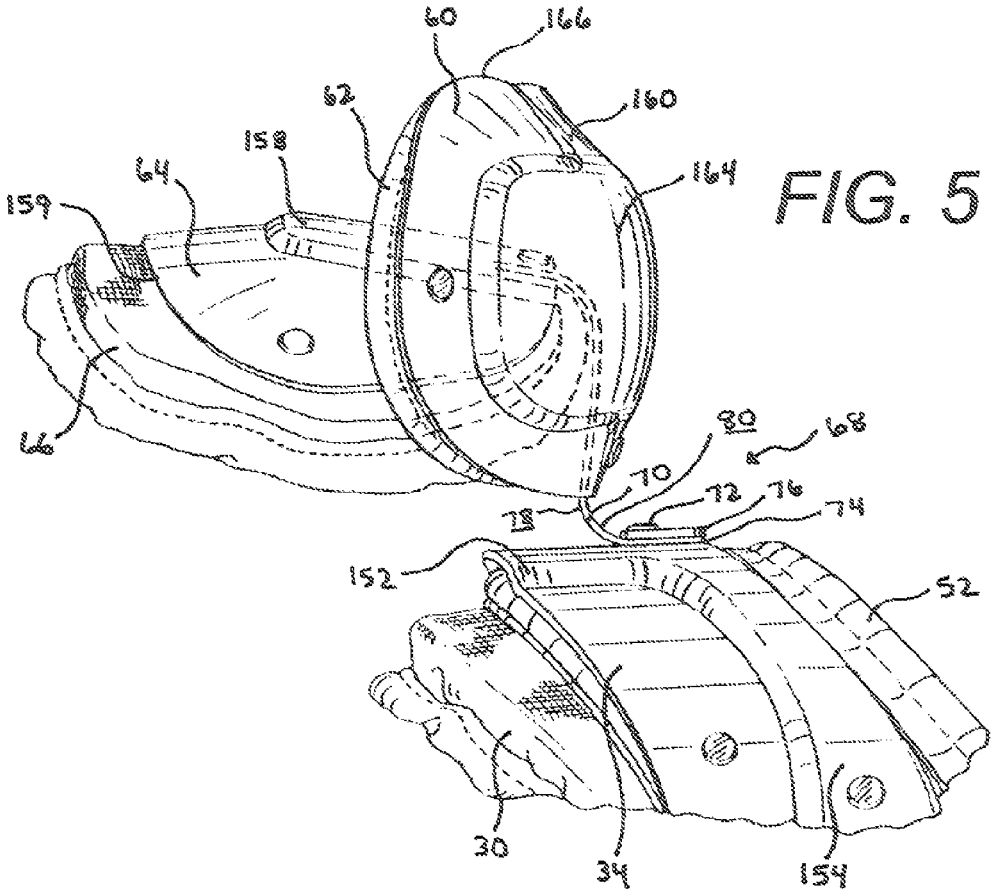
FIG. 5 is a perspective view of the side pad assembly of the shoulder pad assembly of FIG. 1, showing the side pad assembly in an elevated position.
Figure 6:
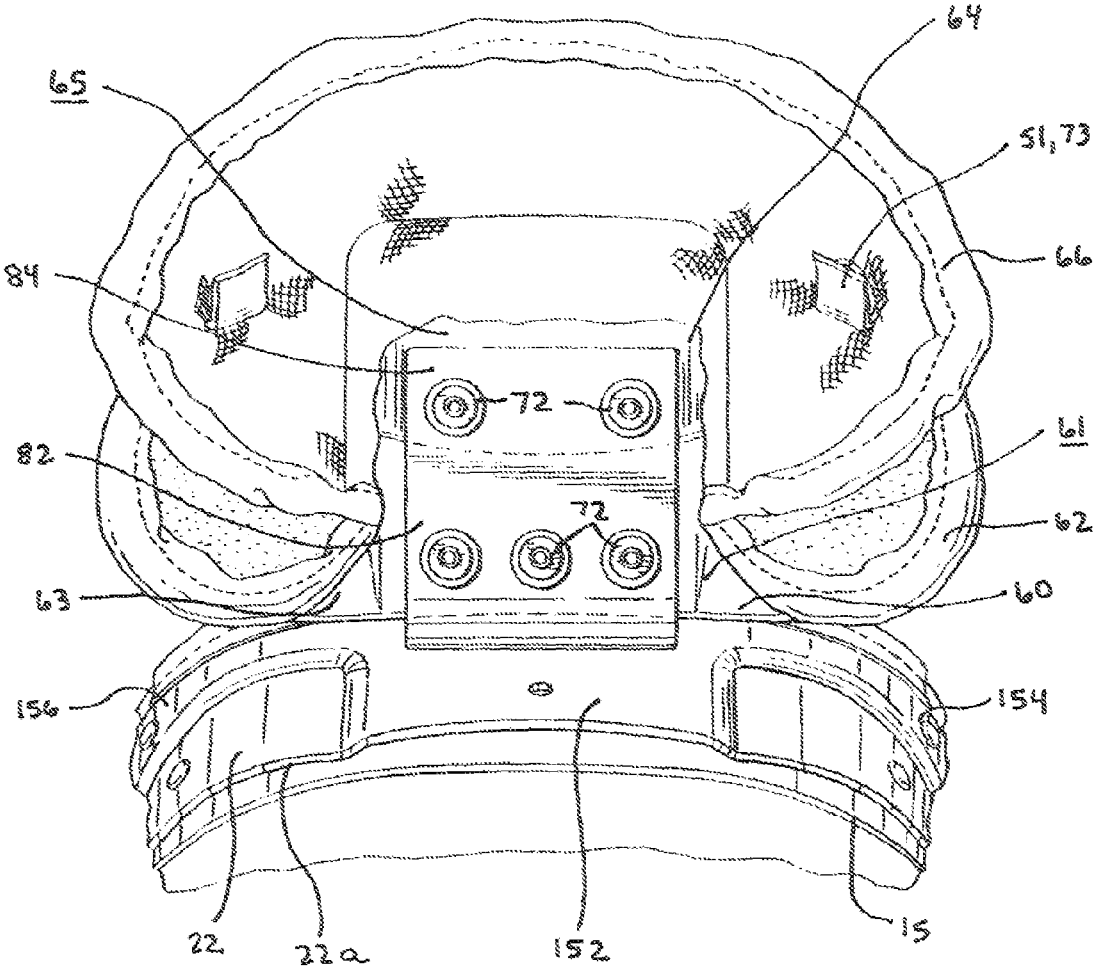
FIG. 6 is an end view of the side pad assembly of the shoulder pad of FIG. 1, showing the side pad in an elevated position.
Figure 7:
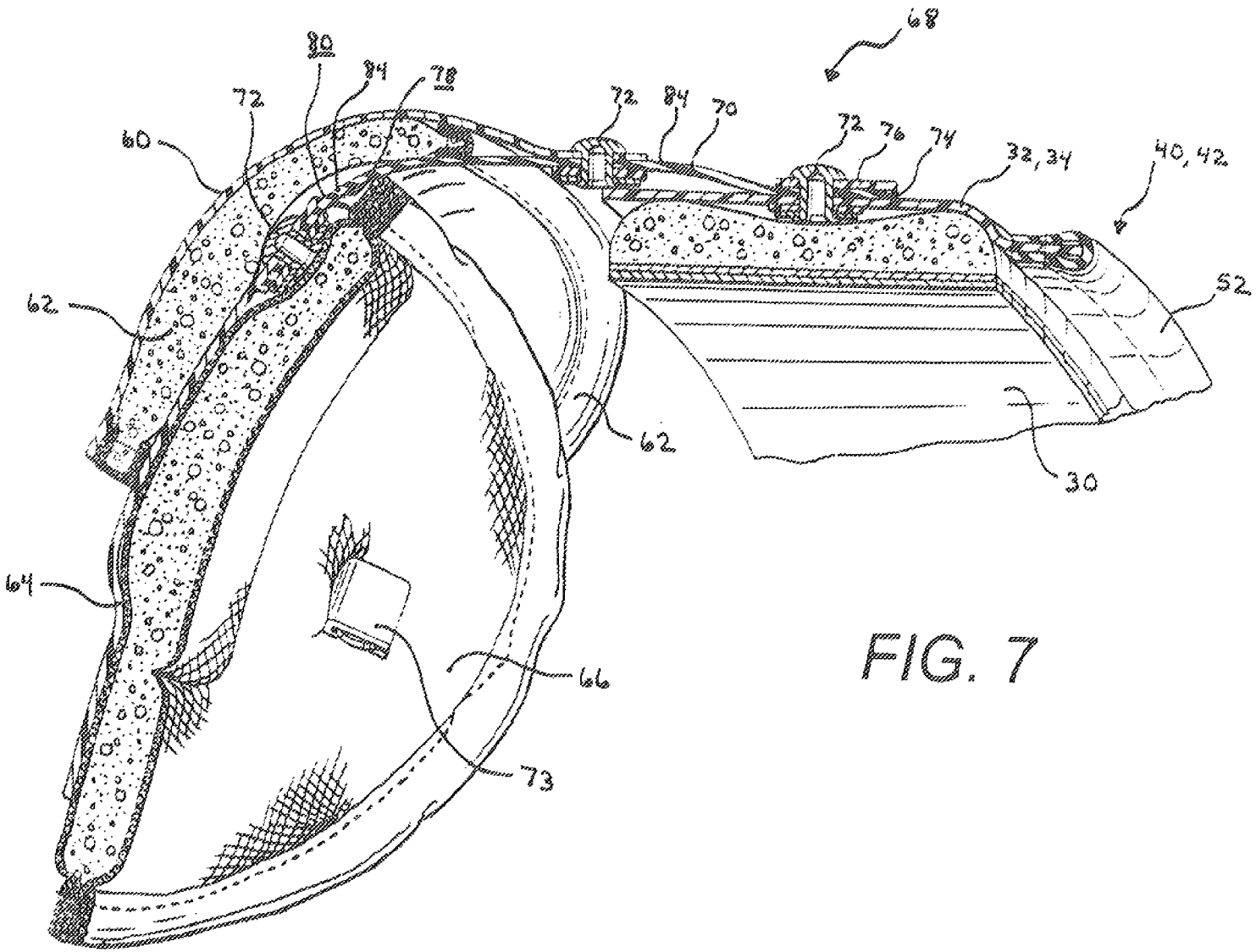
FIG. 7 is a cross section of the shoulder pad assembly taken along line 7-7 of FIG. 1.

The side pad assembly 24, 26 is shown in an elevated position in FIGS. 5 and 6, with a portion of the interior pad 66 removed in FIG. 6 for illustrative purposes. The band 70 has an intermediate portion 82 between the first end 74 and a second end 84. The intermediate portion 82 is affixed to an inner surface 61 of the epaulet 60 by at least one rivet 72. Near the intermediate portion 82, the second or outer surface 80 of the band 70 is in contact with the epaulet 60, while the first or inner surface 78 is in contact with an inner surface 67 of the interior pad 66. In the embodiment shown in FIG. 6, the interior pad 62 defines a recessed portion 63 near the connection area for the band 70 whereby the second surface 80 of the band 70 directly engages the inner surface 61 of the epaulet 60. In another embodiment, the interior pad 62 lacks a recessed portion 63, whereby the second surface 80 of the band 70 engages the interior pad 62 and the rivet 72 extends through the band 70, the interior pad 62, and the epaulet 60. When the side pad assembly 24, 26 is elevated or raised from the arch members 20, 22 in the manner shown in FIGS. 5 and 6, the second surface 80 of the band 70 envelops or wraps an extent of the periphery of the epaulet 60. The second end 84 of the band 70 is affixed to an inner surface 65 of the shoulder cap 64 by at least one rivet 72. Near the second end 84, the second or outer surface 80 of the band 70 is in contact with the shoulder cap 64, while the first or inner surface 78. is in contact with an inner surface 67 of the interior pad 66. Although not shown, a plate 76 may be employed to assist with the fastening of the second end 84 to the shoulder cap 64. In an initial or use position shown in FIGS. 1, 4, 6 and 7, the intermediate portion 82 and the second end 84 of the band 70 are positioned between an outer layer defined by the epaulet 60, the interior pad 62, and the shoulder cap 64, and a inner layer defined by the upper portion 32, 34 of the body arch member 20, 22 and the interior pad 66. In this manner, a significant extent of the band 70 is stacked between the inner layer and the outer layer.

As explained above, the band 70 of the fastening assembly 68 extends from the upper region 32, 34 of the arch member 20, 22 and away from the central opening 50 to flexibly secure the side pad assembly 24, 26 to the respective arch member 20, 22. As a result, the fastening assembly 68 provides a single linked attachment between the side pad assembly 24, 26 and the arch members 20, 22. Described in a different manner, the fastening assembly 68 provides for pivotal movement of the entire side pad assembly 24, 26 about the connection point when an upwardly directed force is applied thereto. Said upward force can result from the wearer raising an arm to throw or catch an object, such as a football. As an example, when the upwardly directed force is applied to the epaulet 60, both the epaulet 60 and the shoulder cap 64 pivot about the connection point on the arch member 22, 24.

Figure 2:
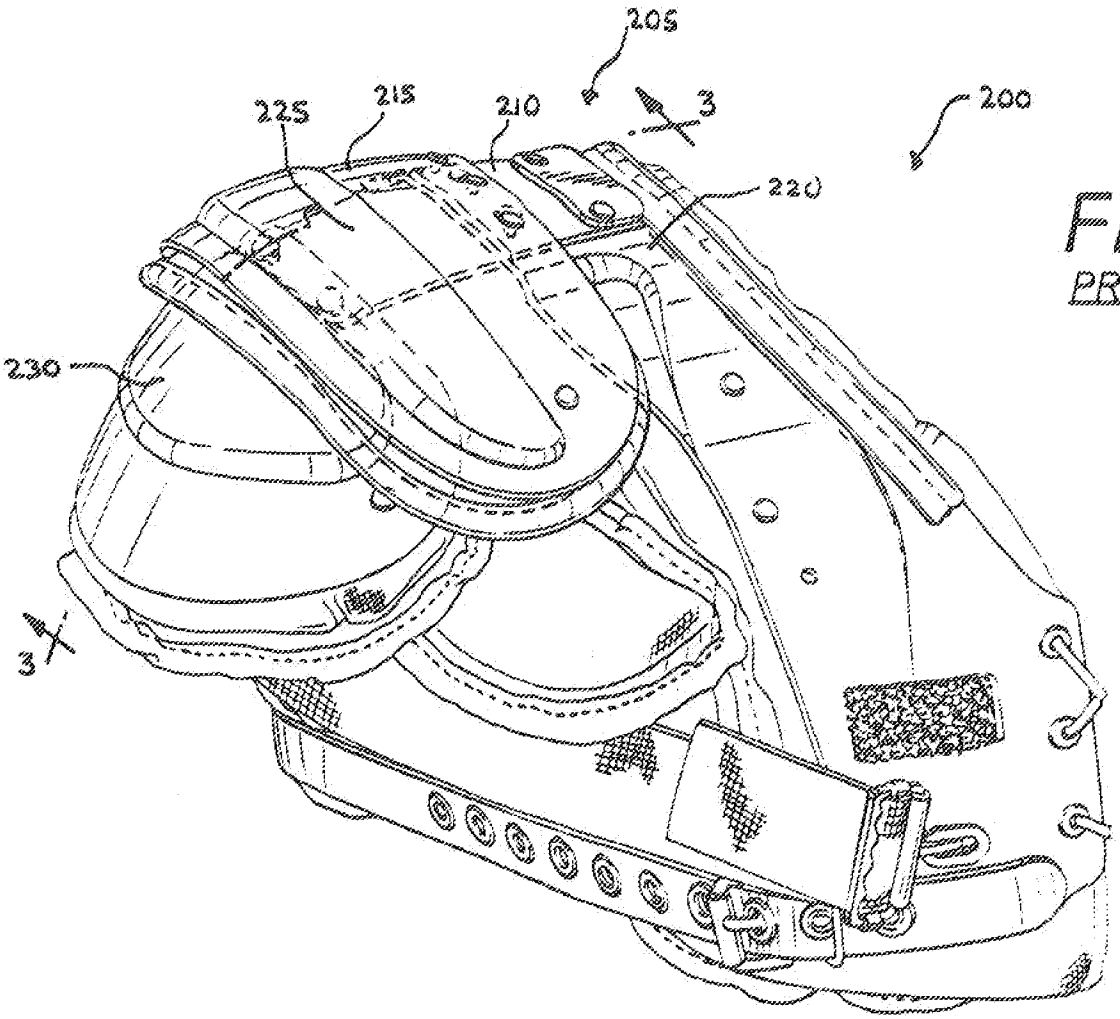
FIG. 2 PRIOR ART
FIG. 2 is a partial perspective view of a prior art shoulder pad.
Figure 3:
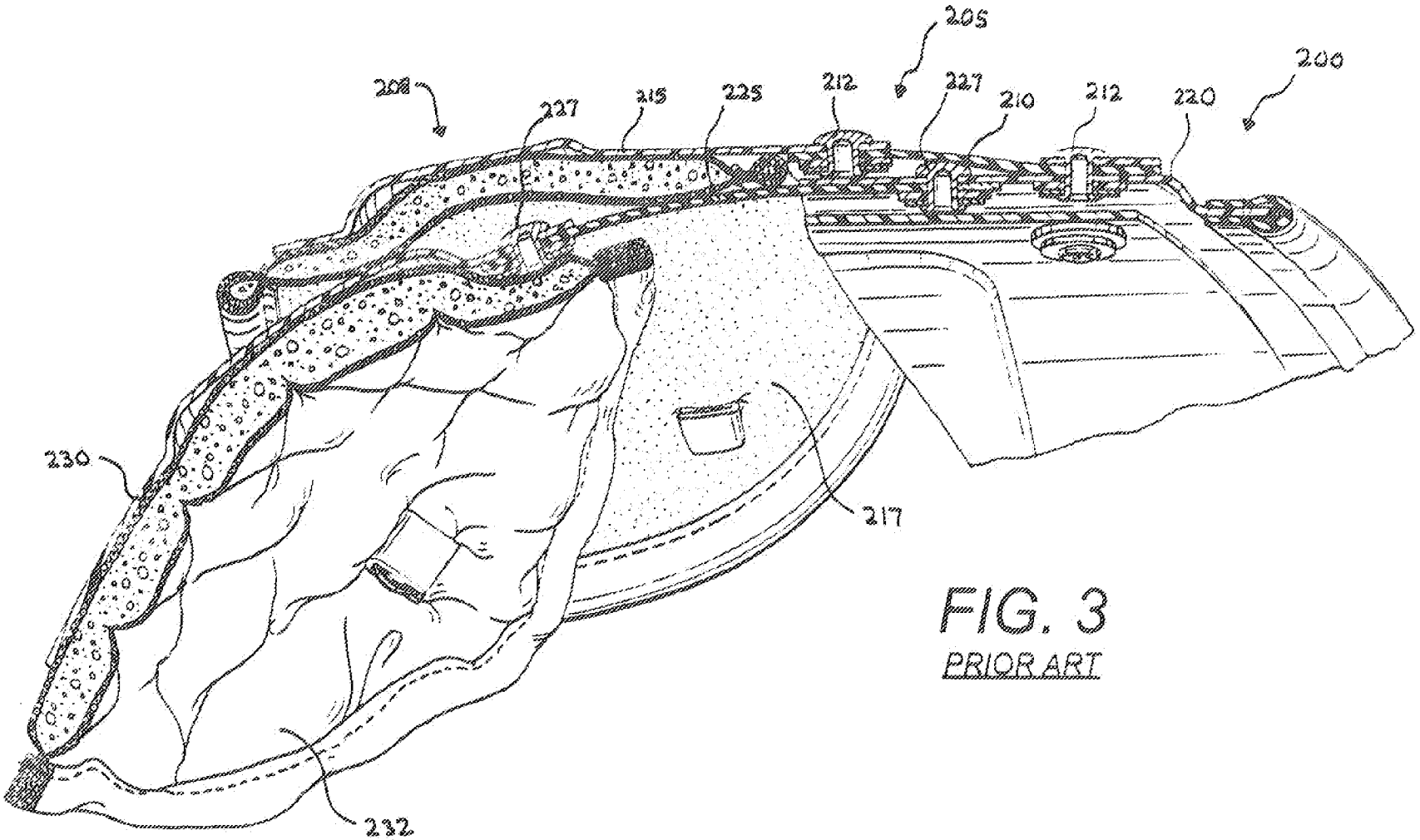
FIG. 3 PRIOR ART
FIG. 3 is a cross-section of the prior art shoulder pad taken along ling 3-3 of FIG. 2.

Unlike the shoulder pad 10 of the present invention, conventional football shoulder pads typically utilize multiple straps and connectors to fasten the side pad assembly to the arch members. FIGS. 2 and 3 show a conventional shoulder pad 200 with a multi-strap fastening assembly 205 for the side pad assembly 208, which consists of the epaulet 215 and the associated interior pad 217, and the shoulder cap 230 and the associated interior pad 232. The fastening assembly 205 includes a first strap 210 that connects the epaulet 215 to the arch member 220 with rivets 212. The fastening assembly 205 further includes a second strap 225 connects the shoulder cap 230 to the arch member 220 with rivets 227. Due to the multiple straps 210, 225, conventional football shoulder pads 200 have multiple connection points for each side pad assembly 208, which decreases the range of motion of the pad assembly 208.

Figure 8:
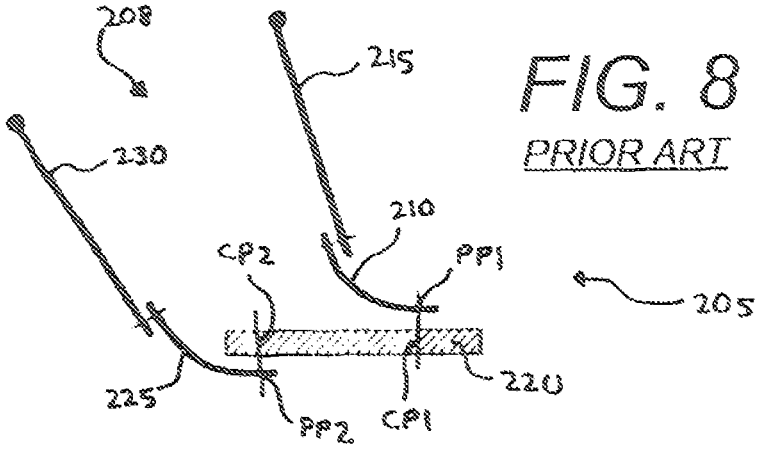
FIG. 8 PRIOR ART
FIG. 8 is a schematic view of the prior art shoulder pad, schematically showing the side pad assembly in an elevated position.
Figure 9:
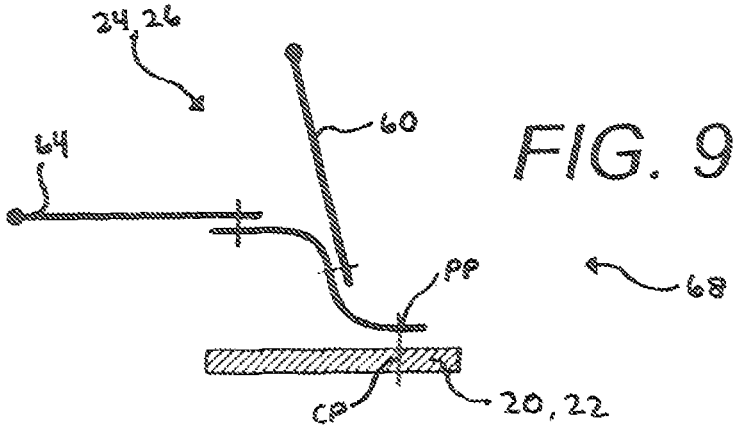
FIG. 9 is a schematic view of the shoulder pad of the invention, schematically showing the side pad assembly in a first elevated position.
Figure 10:
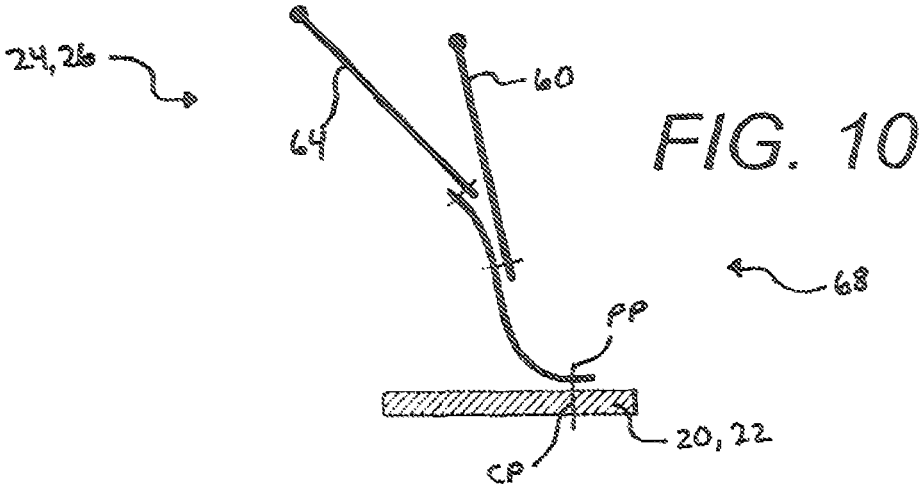
FIG. 10 is a schematic view of the shoulder pad of the invention, schematically showing the side pad assembly in a second elevated position.

In contrast to conventional designs and as schematically shown in FIGS. 8-10, the fastening assembly 68 provides a single pivot point PP for both the epaulet 60 and the shoulder cap 64 about the connection point CP on the arch member 20, 22. The single pivot point PP reflects the location where the side pad assembly 24, 26 pivots about the arch member 20, 22. The conventional shoulder pad 200 is schematically shown in FIG. 8, wherein the fastening assembly 205 has two distinct connectors—the first strap 210 and the second strap 225. The connection between the epaulet 215 and the first strap 210 provides a first pivot point PP1 and a first connection point CP1, while the connection between the shoulder cap 230 and the second strap 225 provides a second pivot point PP2. Due to the two pivot points PP1, PP2 and the two connection points CP1, CP2, the comfort and range of motion of the side pad assembly 208 is reduced.

Compared to conventional devices for securing side pad assemblies to arch members, the fastening assembly 68 of the present invention provides a number of benefits. Primarily, the fastening assembly 68, through the use of the single band 70, provides a greater amount of mobility for the side pad assembly 24, 26 with respect to the arch member 20, 22. As a result, the restrictions placed on the range of movement by conventional devices are not found in the present invention. In addition, when an impact is absorbed by the side pad assembly 24, 26, the fastening assembly 68 helps to maintain the proper positioning of the shoulder pad 10 on the player. Furthermore, the fastening assembly 68 comprises few parts, including the single band 70, and is easily installed on the shoulder pad 10 thereby reducing both material and assembly costs.

Figure 4A:
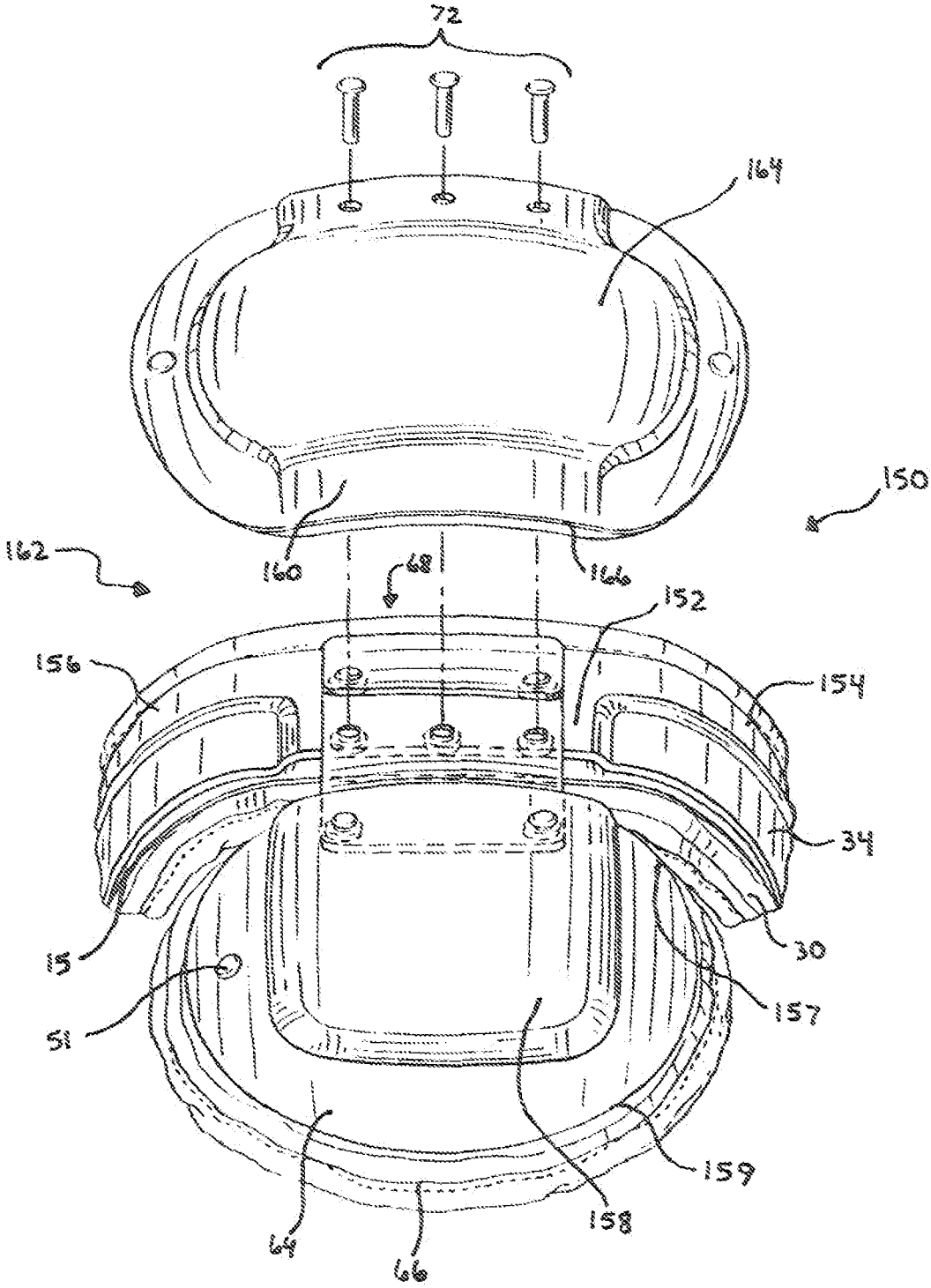
FIG. 4A is an exploded view of the side pad assembly of the shoulder pad assembly of FIG. 1.

The shoulder pad assembly 10 also includes an impact distribution and energy attenuation system 150 that is adapted to distribute an impact force throughout the pad assembly 10. Referring to FIGS. 1 and 4-6, the system 150 includes an upper raised arch segment 152, a front raised arch segment 154, and a rear raised arch segment 156. As shown in FIG. 6, the upper raised segment 152 extends outward from the front and rear raised arch segments 154, 156 to the outer edge 22*a* of the arch member 22. The system 150 further includes a raised segment 158 of the shoulder cap 64 and a raised segment 160 of the epaulet 60. Each of the raised segments 152, 154, 156, 158 represent a corrugation in the pad component, and the raised segments 152, 154, 156, 158 have a height defined by a sidewall that extends from the outer surface of the respective component of the pad assembly 10. In one embodiment, the segment height is approximately 0.25 inch. As shown in FIGS. 1, 4 and 4A, the upper raised arch segment 152 is cooperatively positioned and cooperatively dimensioned with the raised cap segment 158 to define a distribution and absorption channel 162 between the arch member 20, 22 and the cap 64. Therefore, the upper raised arch member 152 has a width that corresponds to a width of the raised cap segment 158. The fastening assembly 68 described above maintains the channel 162 through the close spacing of the cap 64 to the arch member 20, 22. In one embodiment, the inner periphery of the cap 64 is operably positioned approximately 1.0 inch from the outer periphery of the arch member 20, 22.

Referring to FIGS. 4, 4A and 5, the raised shoulder cap segment 158 has a length and extends outward from an inner edge 157 (see FIG. 4A) towards the outer edge 159 of the shoulder cap 64. The length of the raised cap segment 158 can vary with the design parameters of the energy attenuation system 150. For example, the raised cap segment 158 can extend between the inner and outer edges 157, 159 of the shoulder cap 64. Although shown as being uninterrupted or continuous, the raised cap segment 158 can be a series of projections that collectively define the segment 158. The raised epaulet segment 160 extends outward from a raised main portion 164 to the peripheral edge 166 of the epaulet 60. The raised epaulet segment 160 is cooperatively dimensioned and positioned with the raised cap segment 158 to further define the channel 162. The distribution and absorption channel 162 may also include the front and rear raised segments 154, 156 of the arch member 20, 22. Accordingly, the channel 162 may extend through the arch member 20, 22 and outward through the side pad assembly 24, 26. Referring to FIG. 6, there is a curvilinear transition region between the upper raised segment 152 and the front and rear raised segments 154, 156. The sub-arch member 15 may also include a raised segment that is cooperatively dimensioned and positioned with the upper raised segment 152.

When the shoulder pad assembly 10 is worn by a participant in a contact sport, e.g. football, hockey or lacrosse, the impact distribution and energy attenuation system 150 distributes and attenuates an impact force received on the side pad assembly 24, 26 in a controlled manner. An impact force is transferred through the side pad assembly 24, 26 and the arch member 20, 22. However, the system 150 prevents that force from being transferred to the wearer's acromioclavicular area (A.C. area) because the raised segments 152, 158 that overlie that area resist compression. Due to the corrugation that the raised segments 152-158 provide and under normal impact forces experienced during contact sports, the channel 162 does not compress and therefore does not engage the wearer's A.C. area. The channel's 162 lack of compression and engagement prevents the impact force from being transferred to the wearer's A.C. area. While the channel 162 resists compression and engagement with the A.C. area, the unraised portions of the arch member 20, 22 and the shoulder cap 62 compress an amount to engage the wearer's non-A.C. area and transfer the impact force thereto. It is understood that the side pad assembly 24, 26 and the arch members 20, 22 absorb a significant amount of energy thereby reducing the impact force transferred to the wearer.

Figure 13:
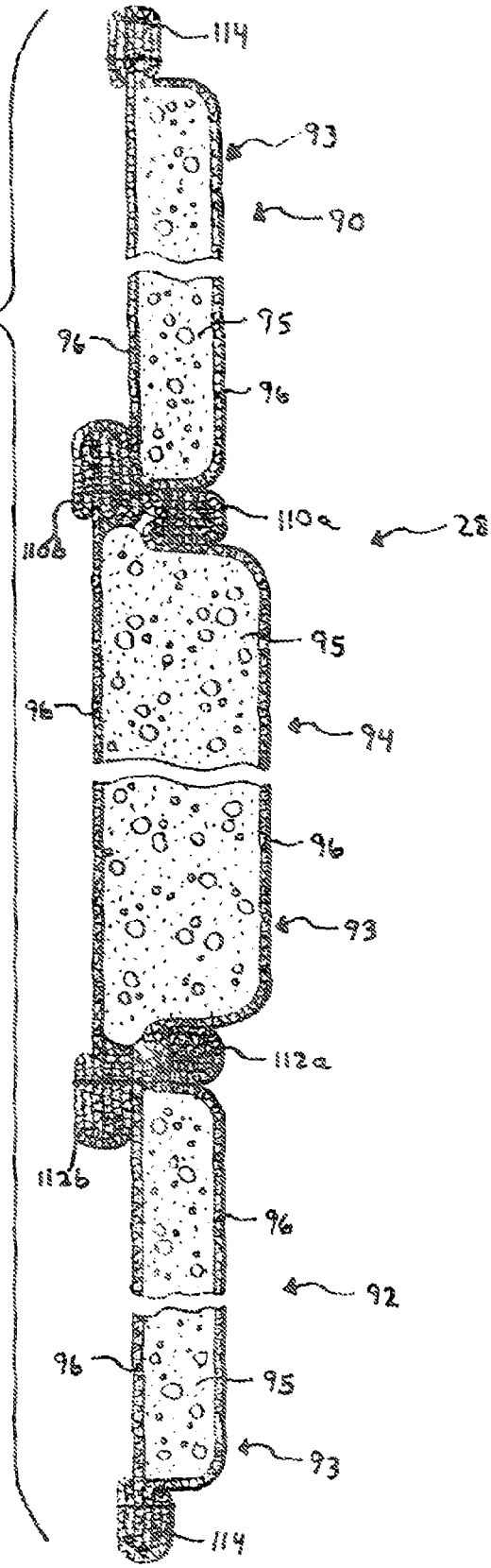

Referring now to FIGS. 11-13, the left and right interior pad assemblies 28, 30 comprise a number of distinct pads joined as integrated padding unit. The interior pad assembly 28, 30 comprises a front pad 90, a rear pad 92, and an intermediate pad 94 positioned between the front and rear pads 90, 92. Alternatively, the interior pad assembly 28, 30 comprises a front pad 90 and a rear pad 92, with the intermediate pad 94 omitted. The pad 90, 92, 94 comprises foam pad element 95 encapsulated in an air-tight membrane 96 (see FIG. 13). The membrane 96 is configured to prevent air from escaping from the pad element 95 when an impact force is applied to the shoulder pad assembly 10. In this manner, each pad 90, 92, 94 forms a distinct air management chamber 93 within the pad assembly 28, 30. Each air management chamber 93 restricts the release of air during an impact, while providing shock absorbing qualities through the compression of the air and the pad element 95 within the chamber 93. When an impact is received across a large area of the arch member 20, 22, such as the upper and front portions 32, 36 of the arch 20, multiple chambers 93 restrict air release and provide shock absorbing qualities. The pad element 95 can be a closed cell or open cell pad, or a combination thereof. The membrane 96 can be formed from flexible plastic, rubber, or air-tight fabric. Once affixed to a body arch member 20, 22, the interior pad 28, 30 extends from the front portion 36, 38 through the upper portion 32, 34 and to the rear portion 40, 42. In this manner, the interior pad 28, 30 is an integrated padding assembly that spans the length of the curvilinear body arch 20, 22. Conventional pad assemblies have a single pad element that spans the length of the body arch, wherein there is single air management chamber that spans the length of the body arch.

The interior pad assembly 28, 30 further includes a first removable pad 98 and a second removable pad 100, wherein each pad 98, 100 is removably received by the intermediate pad 94 with a hook and loop (Velcro.RTM.) fastener. When the pad assembly 28, 30 is installed in the shoulder pad 10, the first and second removable pads 98, 100 are positioned proximate the upper portion 32, 34 of the arch member 20, 22. The intermediate pad 94 has a inner comfort edge 102 that helps to prevent chafing with the player's torso region. The front pad 90 includes means for fastening 104 the pad 90 to the front portion 36, 38 of the body arch 20, 22. Similarly, the rear pad 92 includes means for fastening 104 the pad 92 to the rear portion 40, 42 of the body arch 20, The fastening means 104 is affixed to an inner surface 103 of the pad assembly 28, 30. The fastening means 104 can be a hook and loop (Velcro.RTM.) strap, a snap fastener, or a threaded fastener. As shown in FIG. 1, the fastening means 104 is threaded through openings in the body arch members 20, 22. When the pad assembly 28, 30 is fastened to the body arch member 24, 26, the arch member 24, 26 acts as a throttle for the air released from the pad element 95 upon an impact to the shoulder pad assembly 10.

As mentioned above, the front, rear and intermediate pads 90, 92, 94 are joined to form a single, integrated pad assembly 28, 30. The front pad 90 is joined to the intermediate pad 94 at a front divider or seam 110, and the rear pad 92 is joined to the intermediate pad 94 at a rear divider or seam 112. Referring to FIG. 13, the front seam 110 has a first and second component 110*a*, 110*b*, and the rear seam 112 has a first and second component 112*a*, 112*b*. Edging 114 is located at the periphery of the front, intermediate and rear pads 90, 92, 94. In the embodiment shown in FIGS. 11 and 12, the pads 90, 92, 94 are operably connected within a liner 116 having an exterior liner component 116*a* and an interior liner component 116*b*. Preferably, the exterior liner component 116*a* is a nylon membrane and the interior liner component 116*b* is an air permeable membrane. The liner 116 has a liner edging 118 that defines the periphery of the pad assembly 28, 30. In the cross-sectional view of FIG. 13, the external liner 116 is omitted wherein this omission does not affect the structure of the pads 90, 92, 94 or the chambers 93. There, the pad element 95 is positioned within the membrane 96 of each of the front pad 90, the rear pad 92 and the intermediate pad 94. To form the pads 90, 92, 94, the membrane 96 is heat sealed to enclose the pad element 95. Alternatively, the pad element 95 is enclosed within the membrane 96 via ultrasonic welding, radio frequency welding, or solvent or chemical bonding. To form the pad assembly 28, 30, each pad 90, 92, 94 can be formed separately and then joined together at the seams 110, 112 within the liner 116, or all pads 90, 92, 94 are simultaneously formed within a die having a partition for the seams 110, 112 and within the liner 116.

The resulting pad assembly 28, 30 has a length that corresponds to the length of the body arch 20, 22 thereby providing an integrated padding element for the body arch 20, 22 with multiple air management chambers. Combining and integrating multiple pads 90, 92, 94 as a single pad assembly 28, 30 permits the pad assembly 28, 30 to be easily installed to the arch member 20, 22 compared to the piecemeal installation required by conventional multiple inner pads. As a result, the material and assembly costs of the shoulder pad 10 are lowered. Furthermore, due to the integrated construction of the pad assembly 28, 30, the shoulder pad 10 is more comfortable for the participant to wear while playing the contact sport.

In another embodiment of the present invention, components of the shoulder pad 10, including the arch members 20, 22, the epaulets 60, and the shoulder caps 64 are made of a thermoplastic polypropylene composite material having strength and weight properties not found in the materials used to form conventional pad assemblies. The inventive polypropylene composite material increases the ability of the arch members 20, 22, the epaulets 60, and the shoulder caps 64 to withstand the forces of impact incurred in the contact sport while decreasing the overall weight of the shoulder pad 10. The polypropylene composite material is a moldable fabric that can be used to make rigid sheets and/or formed into shoulder pad components that have a high stiffness-to-weight ratio and high impact resistance, even at low temperatures. The polypropylene composite fabric is comprised of a polypropylene-based tape yarn (often referred to as ribbon yarn) that is woven into a twill or "plain-weave" construction. Preferably, the polypropylene-based tape yarn is flat which makes it possible to achieve a weave and pattern that could not be accomplished with other types of round or substantially round yarns, however, tape yarn, due to its geometry, is more difficult to work with and achieve a perfect stitch. As explained below, the inventive polypropylene composite material provides a significant improvement, for example two to fifteen times, in impact resistance over typical thermoplastics composites. Other advantages of the shoulder pad 10 formed from polypropylene composite material include its recyclability with polypropylene recycle streams and because it is glass free, the polypropylene composite material is free from the safety and processing issues associated with glass-filled composites, namely skin irritation and increased tool wear.

Referring to the table below, the inventive polypropylene composite material has a set of novel material properties not previously associated with conventional materials used to form should pad assemblies. The material properties are measured under ASTM (American Society for Testing and Materials) standards and include the following. Bulk density, also referred to as the specific gravity or density of a solid, measures the mass of the material divided by the total volume occupied, where the total volume includes particle volume, inter-particle void volume and internal pore volume. Density is useful for calculating strength-weight and cost-weight ratios. Tensile modulus provides the ratio of stress to elastic strain in tension. A high tensile modulus means that the material is rigid—more stress is required to produce a given amount of strain—and reflects the ability of a material to resist breaking under tensile stress. Tensile strength represents the tensile stress at a specified elongation, where the maximum tensile strength is the highest tensile stress a material can support before failing under specific test conditions. Other tensile measurements include tensile strength at yield or at break. The tensile force (or stress) per unit area required to break a material in such a manner is the tensile strain to failure. Flexural strength of a material is defined as its ability to resist deformation under load, and represents the highest stress experienced within the material at its moment of rupture. Flexural modulus is the ratio of stress to strain in flexural deformation, or the tendency for a material to bend under an applied force. Heat deflection temperature is the temperature at which a polymer or plastic sample deforms under a specified load, and plays an important role, as it allows for manufacturers to monitor dimensional changes of the finished part with prescribed limits to achieve a faster molding process. Notched izod determines the impact strength of a specimen, where the specimen has a notch oriented towards the direction of impact, and also represents the energy lost per unit of specimen thickness at the notch. Gardner dart impact involves a test that measures the energy required to crack or break flat, rigid plastic specimens under various specified conditions of impact of a striker impacted by a falling weight. Coefficient of thermal expansion (CTE), $\alpha$, is the dimensional response to a temperature change, and includes linear, area and volumetric components.

TABLE 1

Properties of polypropylene material used to form the inventive shoulder pads

| Material Properties | ASTM) | SI (Int'l. System) | English |
|---|---|---|---|
| Bulk Density | D792 | 0.78 g/cm$^3$ | 0.028 lb/in$^3$ |
| Tensile Modulus | D638 | 5-6 GPa | 725,000-870,000 psi |
| Tensile Strength | D638 | 205 MPa | 29,700 psi |
| Tensile Strain to Failure | D638 | 6% | 6% |
| Flexural Modulus | D790 | 5-6 GPa | 725,000-870,000 psi |
| Flexural Strength | D790 | 65 MPa | 9,400 psi |
| Heat Deflection Temperature (455 kPa/264 psi) | D648 | 110° C. | 230° F. |
| Notched Izod (1.25 mm Thick) | D256 | 4.8 kJ/m | 90 ft-lbf/in |
| Gardner Dart Impact (1.25 mm Thick @ −40° C.) | D5420 | 24.7 J | 33.6 ft-lb |
| Gardner Dart Impact (1.25 mm Thick @ 20° C.) | D5420 | 24.5 J | 33.3 ft-lb |
| Coefficient of Thermal Expansion (−30° C.-+30° C.) | D696 | 11 μm/m-° C. | 6.1 μin/in-° F. |

Table 2 provides a constant stiffness comparison of the polypropylene composite material to other common materials, some of which have been used to fabricate shoulder pads. To obtain a required stiffness of a part or article, the geometry, namely the thickness, of the polypropylene material can be reduced compared to a conventional material, as shown in the second column. The third column provides a percentage of weight savings offered by using the polypropylene composite material over the material listed in the first column. Thus, the polypropylene composite material allows for a thinner and lighter part compared to a second part having the same stiffness but formed from other materials. A part, for example the arch members 20, 22, formed from the inventive polypropylene composite material would be 53% thinner and 54% lighter than an arch member formed from HDPE at the same stiffness. In the context of football shoulder pads, the shoulder pad 10 formed from the polypropylene composite material are thinner and lighter weight yet are as stiff as conventional pads.

TABLE 2

Constant Stiffness Comparison

| Material | Polypropylene Composite Thickness Multiple | Polypropylene Composite Weight Savings |
|---|---|---|
| Steel | 3.34 | 65% |
| HDPE (High-density Polyethylene) | 0.53 | 54% |
| SMC (Sheet molding Compound) | 1.15 | 52% |
| ABS (Acrylonitrile Butadiene Styrene) | 0.66 | 52% |
| GMT (Glass Mat Thermoplastic) | 0.97 | 35% |
| Aluminum | 2.32 | 32% |

TABLE 2-continued

Constant Stiffness Comparison

| Material | Polypropylene Composite Thickness Multiple | Polypropylene Composite Weight Savings |
|---|---|---|
| Glass/PP | 1.33 | 28% |
| Carbon/PP | 2.10 | −30% |

Referring to Table 3 (below), the shoulder pad 10 formed from the polypropylene composite material (first row) has increased impact strength as evident by the Gardner Dart Impact test results for this material compared to other commonly used composite and plastic materials.

TABLE 3

Gardner Dart Impact Strength of the Shoulder Pads

| Sample Thickness | Material | Performance at 20° C. (Failure Energy in Joules) | Performance at −40° C. (Failure Energy in Joules) |
|---|---|---|---|
| 1.25 (mm) | Polypropylene composite | 24.5 | 24.7 |
| 1.53 | GMT (Glass Mat Thermoplastic) | 4.2 | 4.2 |
| 1.25 | HPP (Homopolymer PP) | 1.5 | 0.2 |
| 1.25 | ICP (Impact copolymer) | 10 | 5.0 |
| 1.44 | Glass/PP (Continuous woven glass fiber in PP matrix) | 15.9 | 5.0 |

The novel polypropylene composite material may be formed into components of the pad assembly 10, including the arch members 20, 22, the epaulets 60, and the shoulder caps 64 using different molding methods. Regardless of the molding method, the polypropylene composite is fabricated from a coextruded polypropylene tape yarn with a highly drawn core residing within a polymer matrix, which provides a lower melting point for composite processing. Under the first molding method, the tape yarn is woven into a fabric, and multiple layers of the fabric are stacked upon each other and consolidated with heat and/or pressure to form a rigid sheet. The rigid sheet may then be cut into shapes and molded into the components of the pad assembly 10. Multiple sheets may be further consolidated into an assembly through the application of heat and/or pressure. In the second method, rather than stacking and consolidating the material into a sheet, the fabric layers may be stacked and consolidated directly in a mold of the components of the pad assembly 10 to form that particular component (e.g., arch members 20, 22). Stacking and consolidating the fabric layers directly in the mold does not require the production of large sheets of the material, and accordingly improves the efficiency of this method. In either method, the polypropylene composite material is molded using pressure thermoforming techniques known to those in the art. The required pressure is between 10 and 20 bar, and the temperature window is 140° C. to 160° C. Convection heating or controllable infrared heat sources are preferred, but other methods may be used. Also, in either method the fabric layers or sheets may be constrained via clamping during the heating and molding process to prevent shrinkage. An additional advantage is that due to the polypropylene composite's glass-free composition and relatively low pressure requirements, aluminum molds can be substituted for the traditional steel molds.

It is to be understood that the invention is not limited to the exact details of construction, operation, exact materials or embodiments shown and described, as obvious modifications and equivalents will be apparent to one skilled in the art; for example, the entire cantilever strap could be provided with a shock absorbing pad disposed upon its lower surface. Accordingly, the invention is therefore to be limited only by the scope of the appended claims. While the specific embodiments have been illustrated and described, numerous modifications come to mind without significantly departing from the spirit of the invention, and the scope of protection is only limited by the scope of the accompanying Claims.

What is claimed is:

1. A football shoulder pad worn by a player, the shoulder pad comprising:

a pair of continuous arch members joined together to define a central opening, each arch member having a front arch portion depending from an upper arch portion and a rear arch portion depending from the upper arch portion, wherein each arch member is a unitary piece formed from a polypropylene composite material and that extends continuously over the player's shoulder and between the player's chest region and back region;

a side pad assembly operably connected to each arch member by a single flexible band to substantially overlie the player's shoulder region, the side pad assembly comprising an epaulet and a shoulder cap that are both formed from a polypropylene composite material, wherein the shoulder cap resides external to the arch member and the epaulet resides above and against the shoulder cap;

an internal padding assembly removably connected to and extending along each arch member.

2. The football shoulder pad of claim 1, wherein the polypropylene composite used to form the arch members, the epaulet and the shoulder cap is fabricated from a coextruded polypropylene tape yarn with a highly drawn core residing within a polymer matrix.

3. The football shoulder pad of claim 2, wherein the polypropylene tape yarn is woven into a fabric, and multiple layers of the fabric are stacked upon each other and then consolidated with heat and pressure to form a rigid sheet.

4. The football shoulder pad of claim 3, wherein the rigid sheet is cut into shapes and molded into the arch members, the epaulet and the shoulder cap.

5. The football shoulder pad of claim 2, wherein the polypropylene tape yarn is woven into a fabric, and multiple layers of the fabric are stacked upon each other in a mold and then consolidated with heat and pressure to form one of the arch members, the epaulet and the shoulder cap.

6. The football shoulder pad of claim 1, wherein the polypropylene composite used to form the arch members, the epaulet and the shoulder cap is fabricated from a coextruded polypropylene tape yarn with a highly drawn core residing within a polymer matrix, wherein the polypropylene tape yarn is woven into a fabric, and multiple layers of the fabric are stacked upon each other and then consolidated with heat and pressure to form one of the arch members, the epaulet and the shoulder cap through a molding process.

7. The football shoulder pad of claim 1, wherein the polypropylene composite material used to form the arch members, epaulets and shoulder caps has a tensile modulus ranging from 5 to 6 GPa and a tensile strength of 205 MPa, both under ASTM D638 test standard.

8. The football shoulder pad of claim 1, wherein the polypropylene composite material used to form the arch members, epaulets and shoulder caps has a flexural modulus of 5-6 GPa ranging from 5 to 6 GPa and a flexural strength of 65 MPa, both under ASTM D790 test standard.

9. The football shoulder pad of claim 1, wherein the polypropylene composite material used to form the arch members, epaulets and shoulder caps has a Gardner Dart Impact of 24.7 J at −40° C. and 24.5 J at 20° C. with a 1.25 mm sample thickness, both under ASTM D5420 test standard.

10. The football shoulder pad of claim 2, wherein the side pad assembly is connected to the arch member by the band proximate a raised front segment of the arch member, the raised front segment being defined by opposed sidewalls that extend transversely from the front arch portion.

11. A shoulder pad worn by a player engaged in a contact sport, the shoulder pad comprising:

a pair of curvilinear, continuous arch members operatively joined together to define a central opening, wherein each arch member is a unitary piece formed from a polypropylene composite material and that continuously extends over the player's shoulder and between the player's chest region and back region, wherein each arch member has both a raised front segment extending along a substantial extent of a front arch portion and a raised rear segment extending along a substantial extent of a rear arch portion, wherein the raised front and rears segments are defined by a pair of opposed sidewalls that extend transversely from an outer surface of the respective arch portion;

a side pad assembly operably connected to each arch member between the raised front and rear segments, the side pad assembly comprising an epaulet and a shoulder cap formed from a polypropylene composite material and, wherein the shoulder cap resides external to the arch member and the epaulet resides above and against the shoulder cap; and, an internal padding assembly removably connected to and extending along each arch member.

12. The football shoulder pad of claim 11, wherein the polypropylene composite used to form the arch members, the epaulet and the shoulder cap is fabricated from a coextruded polypropylene tape yarn with a highly drawn core residing within a polymer matrix.

13. The football shoulder pad of claim 12, wherein the polypropylene tape yarn is woven into a fabric, and multiple layers of the fabric are stacked upon each other and then consolidated with heat and pressure to form a rigid sheet.

14. The football shoulder pad of claim 13, wherein the rigid sheet is cut into shapes and molded into the arch members, the epaulet and the shoulder cap.

15. The football shoulder pad of claim 12, wherein the polypropylene tape yarn is woven into a fabric, and multiple layers of the fabric are stacked upon each other in a mold and then consolidated with heat and pressure to form one of the arch members, the epaulet and the shoulder cap.

16. The football shoulder pad of claim 11, wherein the polypropylene composite used to form the arch members, the epaulet and the shoulder cap is fabricated from a coextruded polypropylene tape yarn with a highly drawn core residing within a polymer matrix, wherein the polypropylene tape yarn is woven into a fabric, and multiple layers of the fabric are stacked upon each other and then consolidated with heat and pressure to form one of the arch members, the epaulet and the shoulder cap through a molding process.

17. The football shoulder pad of claim 11, wherein the polypropylene composite material used to form the arch members, epaulets and shoulder caps has a tensile modulus ranging from 5 to 6 GPa and a tensile strength of 205 MPa, both under ASTM D638 test standard.

18. The football shoulder pad of claim 11, wherein the polypropylene composite material used to form the arch members, epaulets and shoulder caps has a flexural modulus of 5-6 GPa ranging from 5 to 6 GPa and a flexural strength of 65 MPa, both under ASTM D790 test standard.

19. The football shoulder pad of claim 11, wherein the polypropylene composite material used to form the arch members, epaulets and shoulder caps has a Gardner Dart Impact of 24.7 J at −40° C. and 24.5 J at 20° C. with a 1.25 mm sample thickness, both under ASTM D5420 test standard.

20. The football shoulder pad of claim 12, wherein the pad assembly is operably connected to each arch member by a single flexible band secured between the raised front and rear segments.

* * * * *